US006246187B1

(12) United States Patent
Green

(10) Patent No.: US 6,246,187 B1
(45) Date of Patent: Jun. 12, 2001

(54) SYSTEM FOR PROMOTING PASSIVE END OF LIFE LIGHT SOURCE FAILURE

(75) Inventor: John D. Green, Granville, OH (US)

(73) Assignee: NSI Enterprises, Inc., Newark, OH (US)

( * ) Notice: Subject to any disclaimer, the term of this patent is extended or adjusted under 35 U.S.C. 154(b) by 0 days.

(21) Appl. No.: 09/315,614

(22) Filed: May 20, 1999

(51) Int. Cl.[7] ..... H05B 37/00
(52) U.S. Cl. ..... 315/315; 315/209 R
(58) Field of Search ..... 362/20, 276, 802, 362/265; 315/32, 35, 36, 186, 185 R, 127, 128, 315, 91, 212, 254, 266, 209 R; 331/78

(56) References Cited

U.S. PATENT DOCUMENTS 3,914,690 10/1975 Shelnutt .
4,488,092 12/1984 Chikuma .
4,547,705 10/1985 Hirayama et al. .
4,847,536 7/1989 Lowe et al. .
4,853,599 8/1989 Singarayer .
4,912,375 * 3/1990 Déglon et al. ..... 315/306
4,996,463 * 2/1991 Horowitz ..... 315/250
5,103,193 * 4/1992 Von Bokern ..... 331/78

* cited by examiner

*Primary Examiner*—Don Wong
*Assistant Examiner*—Trinh Do Dinh

(57) ABSTRACT

A system for promoting passive end of life light source failure in response to thermal cycling of the light source includes an automatic relay in communication with a ballast or groups thereof for interrupting power to the associated light sources. Alternatively, the relay may be configured to short out the light source directly. The automatic relays are configured to turn off associated light sources at predetermined or random times for predetermined or random durations.

1 Claim, 1 Drawing Sheet

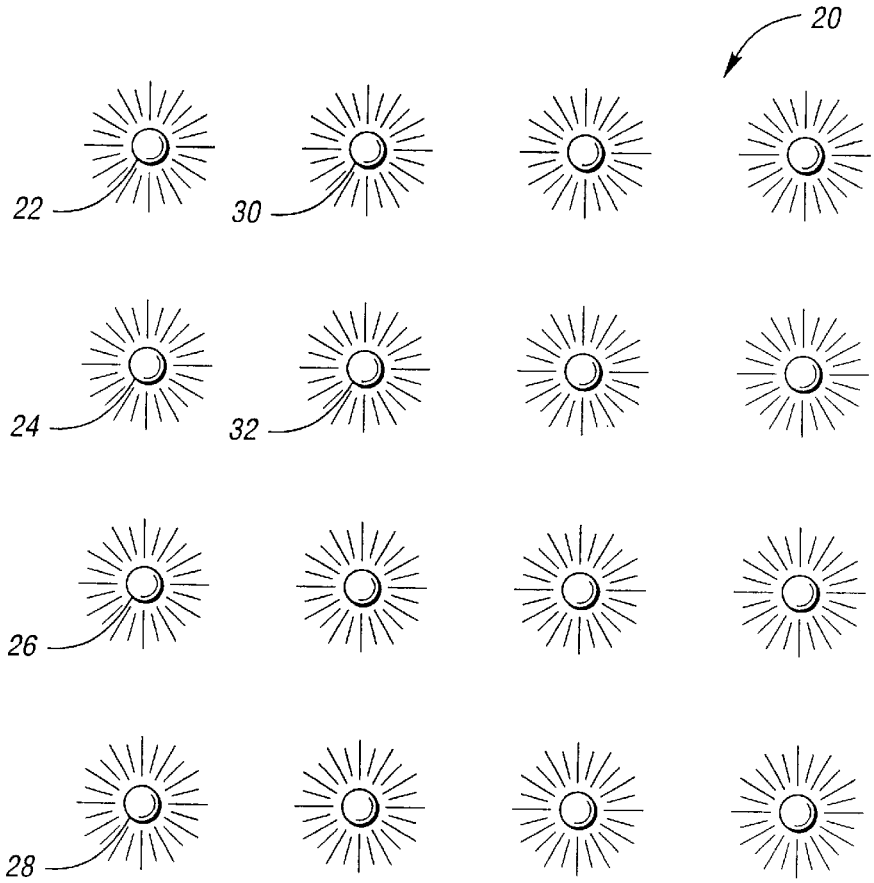
Fig. 1
Fig. 2
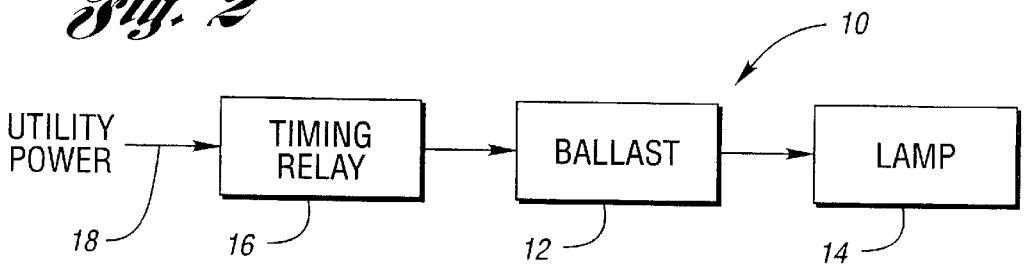
Fig. 3
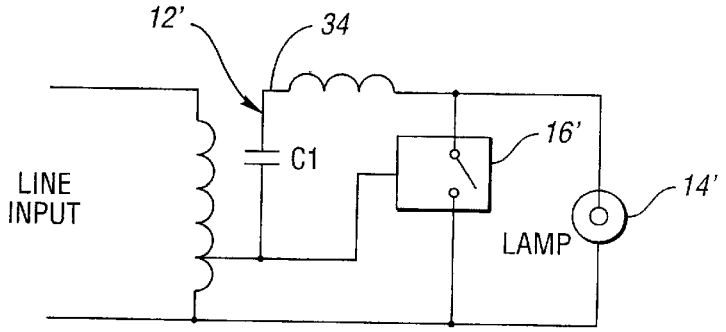

SYSTEM FOR PROMOTING PASSIVE END OF LIFE LIGHT SOURCE FAILURE

TECHNICAL FIELD

This invention relates to electrical assemblies for luminaires and, in particular, to an electrical assembly adapted to automatically turn off a light source so as to promote passive end of life light source failure in response to thermal cycling.

BACKGROUND ART

Indoor suspended lighting fixtures such as those used in warehouse and other commercial and retail settings typically utilize high intensity discharge (HID) lamps because of their superior efficiency and high light output. As those skilled in the art will recognize, however, these lamps and other high wattage light sources have been found to be susceptible to non-passive end of life failure particularly when operated continuously for all or a substantial part of their useful life.

Non-passive lamp failures generally occur in response to crack propagation of the associated arc tube. Specifically, when the internal arc tube ages and develops minute faults, the lamp may crack thus allowing the high pressure to force hot arc tube fragments through the outer glass jacket. If the associated luminaire is not suitably enclosed, falling arc tube fragments may, of course, pose a danger to personnel and property. Because many luminaires are not enclosed, non-passive end of life light source failure continues to be an issue of great concern to lamp manufacturers and lighting designers.

To prevent non-passive light source failures, high intensity discharge lamp manufacturers recommend periodic cycling of all lamps. Where lamps are used in applications that run continuously, lamp manufacturers require regular cycling typically once a week.

In operation, the high wattage light source such as, for example, an HID lamp, is periodically cycled off and then back on. An arc tube that has developed a weakness will fail during the cool down and subsequent warm up cycle because of the additional thermal contraction and expansion stresses experienced by the arc tube. To accomplish the required cycling of these lamps, the owner of the facility must de-energize then re-energize an entire electrical circuit. Because in many applications the lamps are running continuously, however, such cycling interrupts the facility's operation. Unless timers are attached to each circuit, there is also the possibility that an owner or her representative will not perform this cycling on a regular basis.

Consequently, a need exists for an improved electrical assembly for a luminaire which is adapted to automatically turn off a light source so as to promote passive end of life light source failure and substantially reduce or eliminate danger to personnel and property especially in open luminaire applications.

DISCLOSURE OF INVENTION

It is a principal object of the present invention to provide an improved luminaire and electrical assembly adapted to promote passive end of life light source failure.

It is a further object of the present invention to provide such an electrical assembly which is adapted to turn off the associated lamp.

It is a further object of the present invention to provide such an electrical assembly which is adapted to interrupt power to the associated lamp for predetermined periods of time.

It is yet a further object of the present invention to provide such an electrical assembly which is adapted to interrupt power to the associated lamp at predetermined or random times thereby reducing or eliminating the associated design and labor costs of installing special wiring for an array of luminaires.

It is still a further object of the present invention to provide such an electrical assembly which is adapted to interrupt power to the associated lamp for predetermined or random durations.

Still further, it is an object of the present invention to provide an electrical assembly which is adapted to turn off the lamp at predetermined or random periods of time for predetermined or random durations by shorting it out.

In carrying out the above objects and other objects, features, and advantages of the present invention, there is provided an improved electrical assembly for a luminaire. The assembly includes a ballast adapted to power a light source and an automatic relay device. The automatic relay device is provided in electrical communication with the ballast and is adapted to receive power from a power source such as a utility feed. In operation, the relay device interrupts power to the ballast and thus the light source for predetermined periods of time so as to promote passive end of life light source failure in response to thermal cycling of the light source.

In an alternative embodiment, the light source itself is shorted out. This is typically, but not necessarily, accomplished by placing the relay device in parallel with the secondary circuit of the ballast.

The cycling provided by the invention is typically, but not necessarily, random. Such cycling allows individual lamps or groups thereof to be temporarily de-energized without disrupting the application such as would occur if entire lighting circuits were powered off.

BRIEF DESCRIPTION OF DRAWINGS

FIG. 1 is a schematic diagram of a representative array of luminaires using the electrical assembly of the present invention;

FIG. 2 is a block diagram of the electrical assembly of the present invention; and FIG. 3 is a block diagram of an alternative embodiment of the present invention.

BEST MODE FOR CARRYING OUT THE INVENTION

Referring to FIG. 1 of the drawings, there is shown a schematic diagram of a representative array of luminaires each having a light source such as, for example, an HID lamp and including an electrical assembly of the present invention shown in more detail in FIG. 2. Electrical assembly 10 includes a ballast 12 adapted for electrical communication with a light source such as a High Intensity Discharge (HID) lamp 14. Electrical assembly 10 further includes an automatic relay device 16 which is provided in electrical communication with ballast 12 and is adapted to receive power from a power source such as utility power or feed 18.

In keeping with the invention, relay device 16 is placed in each luminaire of array 20 to cycle the lamp 14 off and back on so as to fulfill the lamp manufacturer's requirements and recommendations. Relay 16 is typically, but not necessarily, serially connected (back-to-back) SCRs (not shown). In a preferred embodiment, relay device 16 is designed to have predetermined random cycling on-periods ranging from approximately 100 to 600 hours or any other suitable cycling time. At these random intervals, the relay 16 interrupts power to the ballast 12 thereby extinguishing the HID lamp 14. Power may be restored within a predetermined period of time such as, for example, one minute. Because of the characteristics of the high wattage lamp 14 and, in particular, the HID lamp illustrated, it will not re-ignite until the arc has cooled to the point that the ballast voltage can break down the associated internal gasses. As those skilled in the art will recognize, this process can range anywhere from 4–15 minutes or longer depending upon the specific luminaire design. This cool-down period thus fulfills the lamp manufacturer's cycling requirements and recommendations so as to minimize, if not eliminate, non-passive failures without the owner's intervention. In any case, the "off" time can be set to meet the requirements of the lamp manufacturer.

Electrical assembly 10 of the present invention is adapted to control each associated luminaire individually. Relay 16 is therefore designed to have a wide range of random cycling times that vary with each device. This will ensure that multiple luminaires will not be interrupted at the same time thus minimizing localized reduced illumination problems. While it is, of course, possible that more than one luminaire in an array 20 may be off at the same time, the probability is low that adjacent luminaires such as luminaires 22 and 24, 26 and 28, or 30 and 32, etc. will have overlapping interruption. If even the low probability of overlapping interruption periods is of concern, an alternative embodiment is disclosed herein wherein a variety of relays may be used in an associated luminaire array each having more precise timing intervals of different values. In this manner, luminaires using relays of the same time interval may be located in an application such that the outage time may be coordinated with the operation of the facility.

The mixture of timing intervals will ensure that an entire section of an array will not have overlapping interruption periods. Moreover, the precise interval of this approach will allow owners and users to predict with specificity when power interruptions will occur. While, of course, functional, this alternative embodiment will require substantial additional design and labor so as to ensure that luminaires are installed in compliance with an associated outage pattern. While such attention to detail in the installation of general lighting equipment is not the norm, it may, of course, be required depending upon the desired application.

In keeping with the invention, relay device 16 may also be programmable to achieve the desired outage pattern or patterns. For example, relay 16 may be designed to have different (predetermined) or random future turn off times and durations. That is, it randomizes or is pre-set for its next turn off time and/or duration following each turn off event.

If overlapping interruption is not a concern but desired, electrical assembly 10 of the present invention can, of course, be adapted to control groups of luminaires in array 20. In this manner, relay 16 will be provided in electrical communication with a plurality of luminaires such as luminaires 22–28.

With reference to FIG. 3, there is shown a schematic of an alternative embodiment of the present invention wherein the relay device 16' is configured to directly short the lamp 14'. As shown, relay 16' is connected in parallel with secondary coil 34 of ballast 12' so as to short lamp 14'. This arrangement would typically find application in HID circuits where the secondary coil 34 of ballast 12' is current limited. In such cases, the current handled by the relay device 16' will thus be less than in the above embodiment wherein relay 16 is used to control the primary coil of the ballast.

The benefit of this alternative embodiment is that the relay 16' is normally "off" in this configuration, and only handles current for a limited period of time, approximately 15 minutes each week. When the relay 16 is in the primary of the ballast, it is essentially "on" all the time. Since the relay 16' is off most of the time, it will run cool resulting in improved reliability.

A second benefit derives from the failure modes of this type of device. Solid state relays are most suitable for this type of switching (because of cost reasons related to the need for random timing), and attention must be paid to their failure mode. The power output stage of a solid state relay are back-to-back SCRs, and they normally fail in a shorted manner. In most cases, the relay device 16 will stop conducting for one direction of the AC power, resulting in a half-wave rectification condition. For a transformer, this causes high currents that would probably cause a fuse to blow. This is a desirable result, since it would indicate to the user that the relay had failed and needs maintenance.

However, in some instances both SCRs may fail shorted, which would allow the ballast to operate normally. For a device that is to turn off luminaires to avoid permanent "on" situations, a failure mode where the relay keeps the ballast "on" is not entirely desirable. With the relay shorting out the lamp, as in the alternative embodiment, either failure mode (one or both SCR failures) would force the lamp to go out and indicate maintenance is required.

Still further, there is another benefit of the relay device 16' being in the secondary 34 of the ballast 12'. Since the relay 16' requires a power source to operate, the configuration where the relay 16 is in the primary requires a wide range of operating voltages to be compatible with utility voltages of 120 to 480 volts. Since the secondary of the ballast has a much more consistent voltage present (especially across the range of HID lamps), the relay 16' may be designed for a more narrow range of power voltages.

For those lamps that require a pulse to ignite the lamp, the relay 16' will "see" the pulses across its output during lamp starting. These 2,000 to 4,000 volt pulses must be addressed in the relay design through the use of snubbers (not shown) or other suitable voltage limiting devices.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A luminaire assembly comprising:

a light source; and an electrical assembly having a ballast including a primary coil and a secondary coil, and an automatic relay, the relay connected in parallel with the secondary coil of the ballast and the light source, whereby the relay interrupts power to the secondary coil for predetermined periods of time;

wherein the relay is operative in an on condition to short out the light source so as to promote passive end of life light source failure in response to thermal cycling of the light source.

* * * * *